US011236714B2

(12) United States Patent
Choi et al.

(10) Patent No.: US 11,236,714 B2
(45) Date of Patent: Feb. 1, 2022

(54) RESONATOR HAVING EXCELLENT AIRTIGHTNESS

(71) Applicant: HS R & A CO., LTD, Gyeongsangnam-do (KR)

(72) Inventors: Jae Hyeok Choi, Gyeongsangnam-do (KR); Guk Hyun Kim, Gyeongsangnam-do (KR); Poum Jin Chon, Gyeongsangnam-do (KR); Jung Min Seo, Gyeongsangnam-do (KR); Jung Hyun Shin, Busan (KR)

(73) Assignee: HS R & A CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 16/671,131

(22) Filed: Oct. 31, 2019

(65) Prior Publication Data

US 2020/0141372 A1 May 7, 2020

(30) Foreign Application Priority Data

Nov. 5, 2018 (KR) ..... 10-2018-0134350

(51) Int. Cl.
*F02M 35/12* (2006.01)
*F02M 35/10* (2006.01)

(52) U.S. Cl.
CPC .... *F02M 35/1266* (2013.01); *F02M 35/1211* (2013.01); *F02M 35/10157* (2013.01)

(58) Field of Classification Search
CPC ..... F02M 35/1266; F02M 35/1211; F02M 35/10157

(Continued)

(56) References Cited

U.S. PATENT DOCUMENTS 7,934,581 B2 * 5/2011 Kim ..... F04D 29/665 181/250
9,625,077 B2 4/2017 Barbolini et al.

(Continued)

FOREIGN PATENT DOCUMENTS

CN 102996302 A 3/2013
CN 104234890 A 12/2014

(Continued)

OTHER PUBLICATIONS

Office Action dated Nov. 11, 2019 from Korean priority Application No. 10-2018-0134350 (8 pages including English translation).

(Continued)

*Primary Examiner* — Lindsay M Low
*Assistant Examiner* — Omar Morales
(74) *Attorney, Agent, or Firm* — Crowell & Moring, LLP; John C. Freeman

(57) ABSTRACT

A resonator divides and forms a sound attenuation space and maintains airtightness without external force. The resonator includes a tubular cover body and having a hollow portion with different diameters, a tubular insert inserted into the cover body and having second hollow portion that turbocharger air is introduced into the second hollow portion, the air being guided into the first hollow portion on an outer surface of the insert body; and one or more space partition members coupled to the outer surface of the insert body to form airtight noise attenuation spaces. The partition members are ring shaped, and each space partition member is formed of a resilient material, and each space partition member has a contact portion formed by an inclined surface to be in contact with the inner surface of the cover body in a direction in which the insert body is inserted into the cover body.

2 Claims, 7 Drawing Sheets

(58) Field of Classification Search
USPC ..... 123/184.57
See application file for complete search history.

(56) References Cited

U.S. PATENT DOCUMENTS

| | | | | |
|---|---|---|---|---|
| 10,612,501 | B2 | 4/2020 | Lee et al. | |
| 2010/0193282 | A1 | 8/2010 | Kim et al. | |
| 2016/0238175 | A1* | 8/2016 | Barbolini | F02M 35/1266 |
| 2018/0223779 | A1* | 8/2018 | Buck | F02M 35/10295 |
| 2018/0245553 | A1 | 8/2018 | Lee et al. | |

FOREIGN PATENT DOCUMENTS

| | | | |
|---|---|---|---|
| CN | 105888899 | A | 8/2016 |
| DE | 20 2016 104 445 | U1 | 10/2016 |
| DE | 20 2016 104 624 | U1 | 1/2017 |
| EP | 3 346 118 | A1 | 7/2018 |
| JP | H 8-49611 | A | 2/1996 |
| KR | 10-2012-0037150 | A | 4/2012 |
| KR | 10-2016-0143124 | A | 12/2016 |
| KR | 10-2017-0025530 | A | 3/2017 |
| KR | 20170025511 | A | 3/2017 |
| KR | 10-2017-0112867 | A | 10/2017 |
| KR | 10 2017-0142580 | A | 12/2017 |

OTHER PUBLICATIONS

Office Action (Decision of Patent) dated Mar. 18, 2020 from Korean priority Application No. 10-2018-0134350 (4 pages including English translation).

Extended European Search Report dated Feb. 14, 2020 from corresponding European Patent Application No. 19191263.3 (7 pages).

Office Action dated May 7, 2021 (8 pages including English translation) from corresponding Chinese Patent Application No. 201911069157.9.

* cited by examiner

RESONATOR HAVING EXCELLENT AIRTIGHTNESS

CROSS-REFERENCE TO RELATED APPLICATION

This application is based on and claims priority under 35 U.S.C. 119 to Korean Patent Application No. 10-2018-0134350, filed on Nov. 5, 2018, in the Korean Intellectual Property Office, the disclosure of which is herein incorporated by reference in its entirety.

BACKGROUND

1) Field

The disclosure relates to a resonator capable of dividing and forming a sound attenuation space in which airtightness is maintained without being pressurized by an external force.

2) Description of Related Art

The above information is presented as background information only to assist with an understanding of the disclosure. No determination has been made, and no assertion is made, as to whether any of the above might be applicable as prior art with regard to the disclosure.

Generally, as illustrated in FIG. 1, a vehicular intake system is provided with an air cleaner, a turbocharger, an intercooler, an air duct, and an engine manifold, and external air introduced into the internal combustion engine by the intake system is repeatedly expanded and compressed to generate intake pulsation.

This intake pulsation phenomenon creates noise due to the pressure change of air, and in particular, causes a resonance phenomenon of air in the interior space of a vehicle body or a vehicle, resulting in a louder noise.

In an intake hose installed at the rear end of the turbocharger in order to suppress such intake noise, a resonator for tuning the intake system to a specific frequency is disposed.

A conventional resonator includes an outer pipe forming an outer shape and an inner pipe inserted into the outer pipe, and a resonance chamber is formed between the outer pipe and the inner pipe to reduce the intake noise by tuning the frequency of air. An inlet port, which is an inlet passage for air, and an outlet port, which is an outlet passage for air, are formed in opposite sides of the inner pipe.

Accordingly, a part of the air flowing into the inner pipe through the inlet port moves to the resonance chamber, and the air moving to the resonance chamber is subjected to frequency tuning by the resonance phenomenon, whereby intake noise is reduced.

However, since a conventional resonator has a limited number of resonance chambers, there is a problem in that the frequency tuning of external air is not performed over a wide band.

In order to solve this problem, Korean Laid-Open Patent Publication No. 2012-0037150 discloses a vehicular muffler in which partition walls extending outwards from the outer surface of the inner pipe in the vertical direction are formed, so that a resonance chamber is divided into a plurality of resonance chambers by the partition walls.

The muffler is manufactured by inserting an inner pipe having the partition walls into an outer pipe to assemble both components.

However, when assembling this conventional muffler, the ends of the partition walls move in the state of being in contact with the inner surface of the outer pipe. Thus, abrasion occurs at the contact portions, and the resonance chambers are not efficiently sealed.

In addition, when the muffler is operated, some of the components are damaged due to contact or impact between the ends of the partition walls and the inner surface of the outer pipe.

Furthermore, there is a problem in that the sealing performance of the resonance chambers is considerably deteriorated because a predetermined gap is created between the partition walls of the inner pipe and the inner surface of the outer pipe due to an assembly tolerance in the process of inserting the inner pipe into the outer pipe.

In order to solve the above-described problems, Korean Laid-Open Patent Publication No. 10-2017-25511 (published on Mar. 8, 2017) discloses another prior art, the characteristic features of which are described. The features include an outer pipe forming an external appearance, an inner pipe, a portion of which is inserted into the outer pipe, and having a plurality of slits formed therein as an air-moving passage, partition walls protruding from the outer surface of the inner pipe towards the outer pipe to be in contact with the inner surface of the outer pipe, and a plurality of resonance chambers communicating with the slits to provide a space for reducing intake noise and having a plurality of spaces divided by the partition walls. Stepped portions extending downwards are formed on the outer pipe to correspond to the side surfaces of the partition walls, and each stepped portion is formed with an elastic member insertion groove recessed inwards in the stepped portion such that an elastic member for sealing the space between the partition wall and the stepped portion is inserted into the elastic member insertion groove. With this configuration, it is possible to solve the above-described conventional problems.

As illustrated in FIG. 2, in the prior art, an O-ring 410, which is a main part for maintaining the airtightness of a resonance chamber, is configured such that the position thereof is capable of being fixed by a support protrusion 216 and each partition wall 321, so that the airtightness of the resonance chamber can be maintained. As a selection for maximizing this effect, the length of the elastic member to be inserted into the elastic member insertion groove 215 is formed to be relatively longer than the depth of the elastic member insertion groove 215, and the O-rings 410 of the partition walls are compressed using the elasticity of the O-rings 410, so that the airtightness of the resonance chambers can be maintained.

However, considering that the O-rings made of a rubber material such as rubber or silicon, it is obvious that the durability of the O-rings is deteriorated with the use time due to frequent entry and exit of air having a certain degree of heat in the state in which the partition walls press the O-rings. Due to the deterioration of the durability of the O-rings, when the outer surfaces of the partition walls 320 come into contact with the support protrusions 216, it is difficult to further maintain the airtightness of the resonance chambers.

SUMMARY

The disclosure is proposed to solve the problems in the prior art described above, and to enable the best airtightness of each resonance chamber even in the state in which the partition walls do not press the O-rings.

In view of the foregoing, a resonator having excellent airtightness according to the disclosure includes: a cover body formed in a tube shape and having therein a first hollow portion formed to have different diameters in a longitudinal direction; an insert body formed in a tube shape and inserted into the cover body and having therein a second hollow portion in a longitudinal direction such that the air of a turbocharger is introduced into the second hollow portion, the air introduced into the second hollow portion being guided into the first hollow portion on an outer surface of the insert body; and one or more space partition members coupled to the outer surface of the insert body to form a plurality of noise attenuation spaces in the first hollow portion, airtightness of each of the noise attenuation spaces being maintained. Each space partition member is formed in a ring shape having a predetermined diameter and has an outer diameter larger than an inner diameter of the cover body, each space partition member is formed of a resilient material through double injection molding to have a buffering function by elastic restoration, and each space partition member, and each space partition member has a contact portion formed by an inclined surface to be in contact with the inner surface of the cover body in a direction in which the insert body is inserted into the cover body.

In addition, the insert body may include: an insertion pipe having a cylindrical shape having opposite ends opened to communicate with the second hollow portion, the insertion pipe being fixedly installed by being partially inserted into the cover body; air discharge holes formed in the outer surface of the insertion pipe in a radial arrangement to be adjacent to each other in a longitudinal direction of the insertion pipe so as to discharge the air introduced into the second hollow portion to each of the noise attenuation spaces; and partition walls formed to protrude on the outer surface of the insertion pipe to have a band shape and to be adjacent to each other in the longitudinal direction, the space partition members being detachably fitted to the partition walls so as to partition the noise attenuation spaces. A protrusion may be further formed to protrude at an outer peripheral surface of an end of each protruding partition wall to be engaged with each space partition member in a male-female manner.

Each space partition member may further include an extension formed to extend downwards such that no clearance is formed in a connection portion between the space partition member and the partition wall.

According to the disclosure, unlike the prior art, it is possible to easily maintain the airtightness of each of the noise attenuation spaces divided by the space dividing members, without pressurizing the space dividing members.

BRIEF DESCRIPTION OF THE DRAWINGS

For a more complete understanding of the disclosure and its advantages, reference is now made to the following description taken in conjunction with the accompanying drawings, in which like reference numerals represent like parts.

DETAILED DESCRIPTION

Hereinafter, a resonator having excellent airtightness (hereinafter, simply referred to as a "resonator") according to the disclosure will be described in detail with reference to the accompanying drawings.

Figure 3:
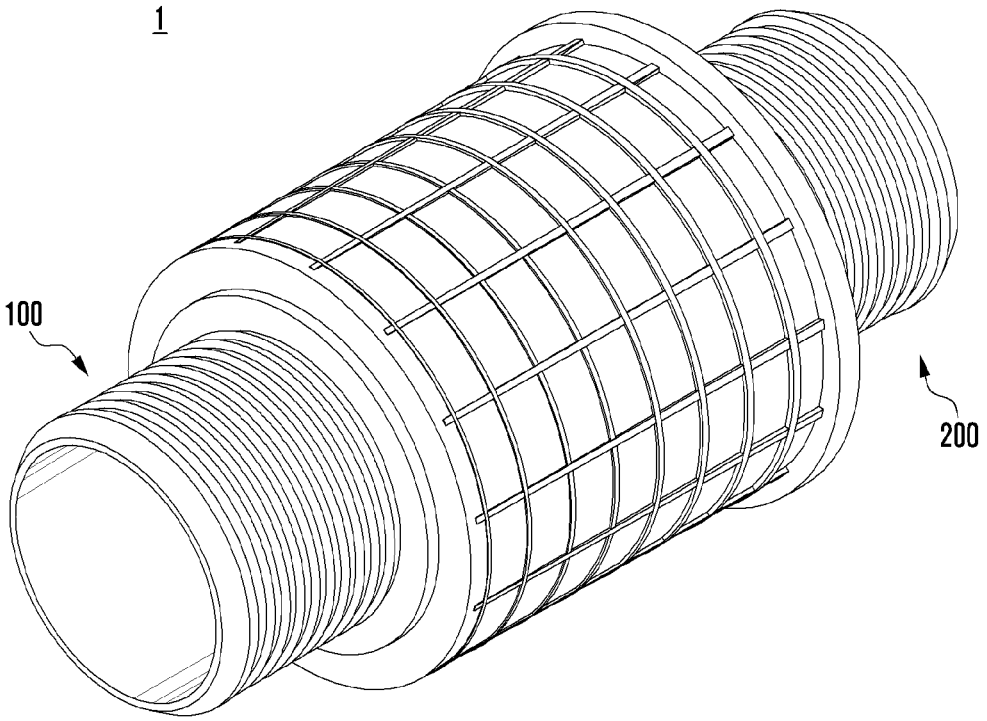
FIG. 3 is a view illustrating a resonator having excellent airtightness according to the disclosure.
Figure 4:
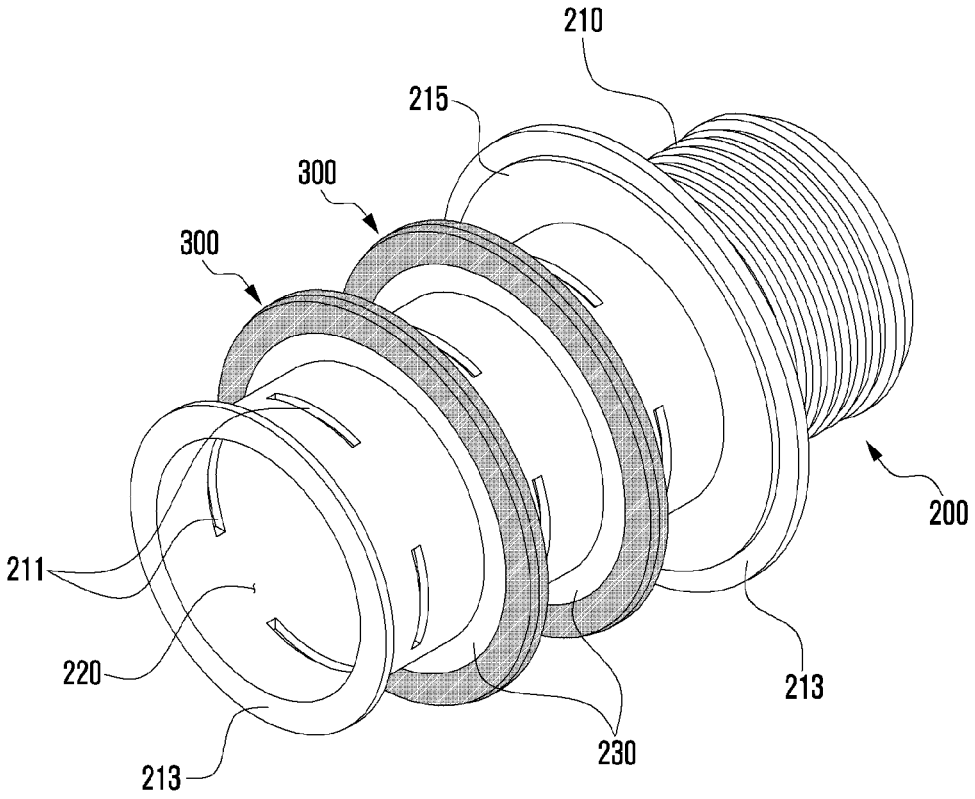
FIG. 4 is view illustrating an insert member and space partition members of the resonator having excellent airtightness according to the disclosure.

First, as illustrated in FIGS. 3 and 4, a resonator 1 according to the disclosure generally includes a cover body 100, an insert body 200, and space partition members 300.

Figure 1:
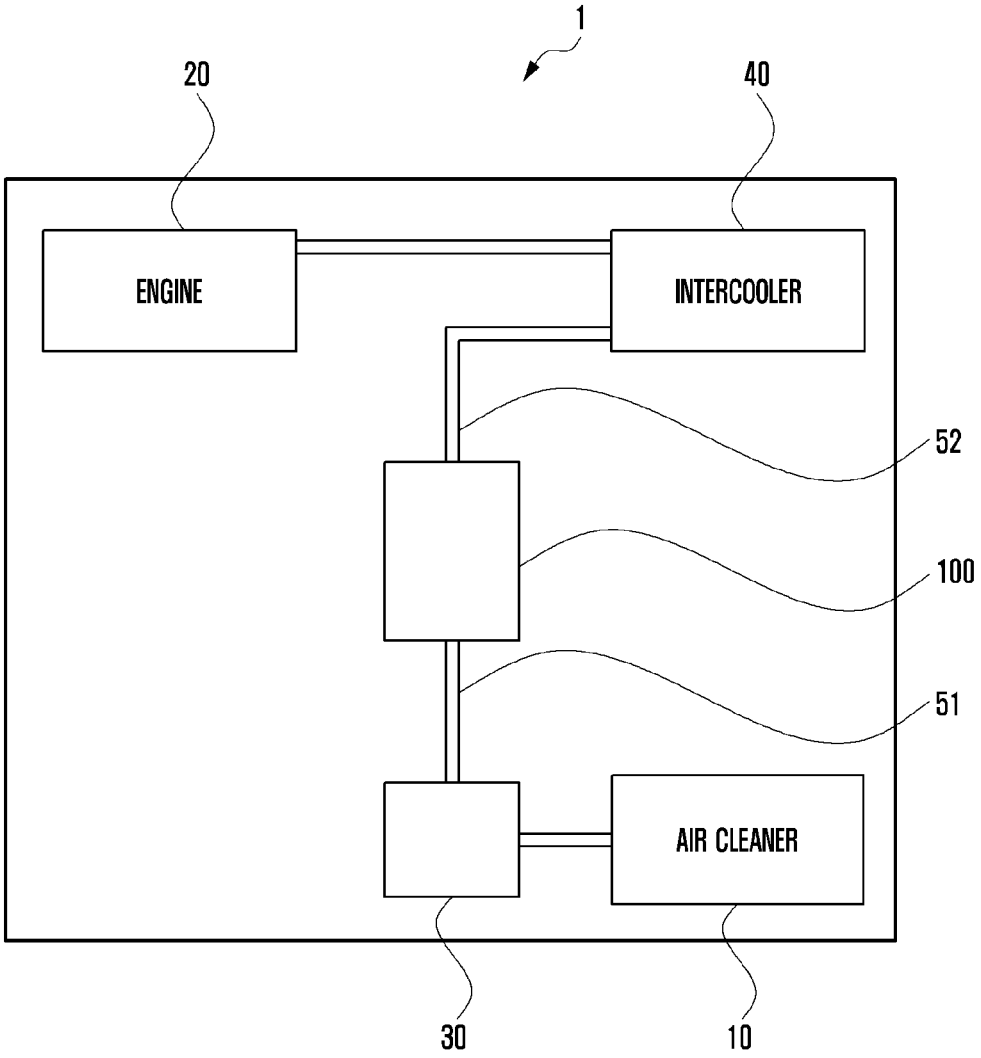
FIG. 1 is a conceptual view illustrating a vehicular intake system equipped with a conventional resonator.
Figure 2:
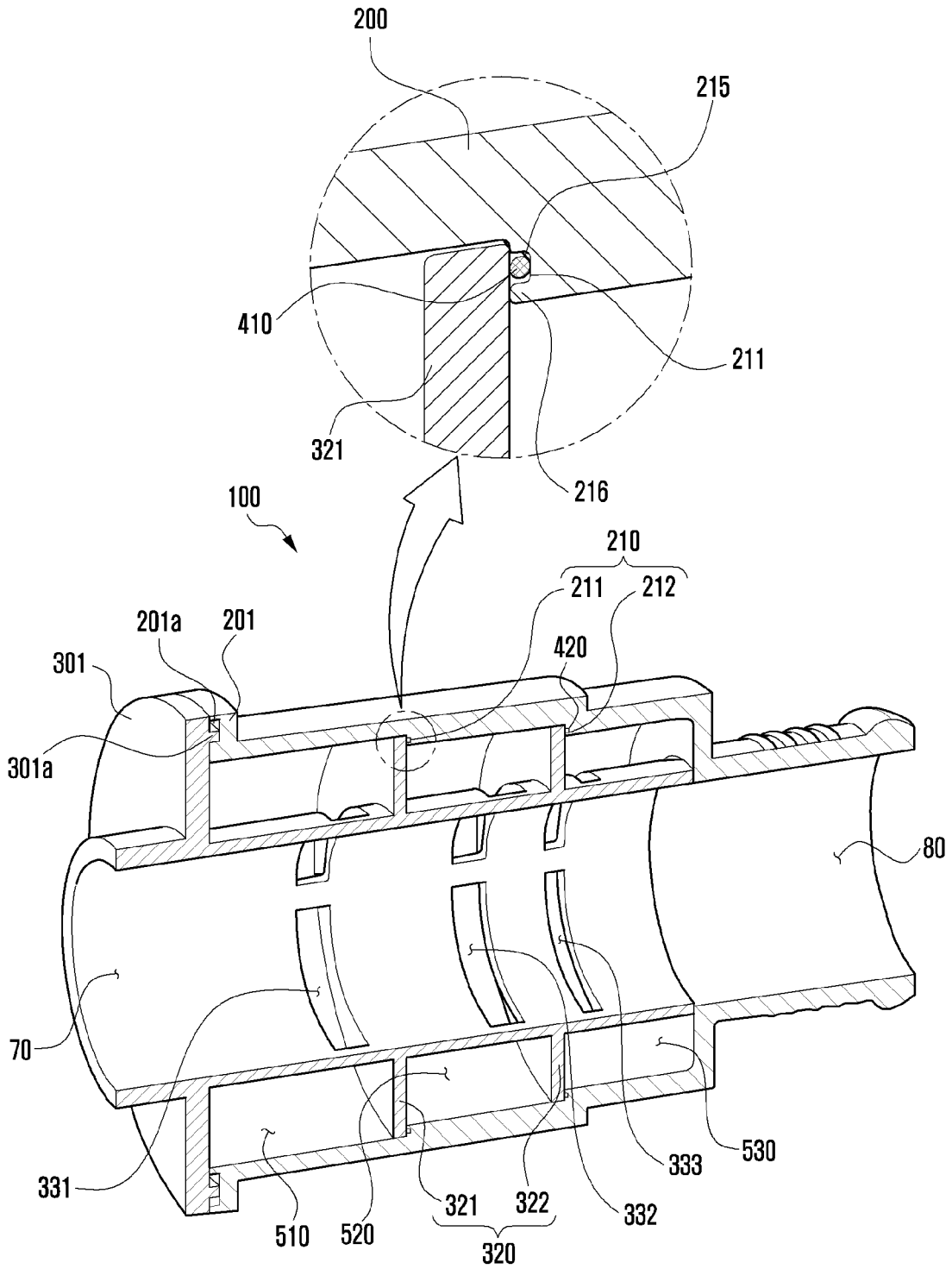
FIG. 2 is a view illustrating the resonator of FIG. 1.

More specifically, the cover body 100 is a configuration into which the insert body 200 (described later) is inserted, and which is connected between an intercooler 40 and a turbocharger 30 so as to cause intake noise, generated from the turbocharger 30 towards the intercooler 40, to be introduced thereinto (see FIG. 1).

For example, the cover body 100 is formed in a cylindrical tube shape, opposite ends of which are opened, and has a first hollow portion 110 formed to communicated with the opened opposite ends such that the insert body 200 can be inserted thereinto and intake noise can be introduced thereinto.

Here, as illustrated in the drawing, the first hollow portion 110 may be formed to have different diameters, in which a lager diameter area Z2 is an area in which noise attenuation spaces 120 are formed by the insert body 200 (described layer) to absorb intake noise, and a relatively smaller diameter area Z1 is an area in which air is discharged after the noise is absorbed.

One side of the cover body 100, that is, the portion opposite the side into which the insert body 200 is inserted, may have a protruding structure to be easily connected to a hose, and threads may be further formed on the outer surface of the protruding structure so as to be screw-coupled with the hose.

In the one side or both sides inside the cover body 100, one or more welding grooves 111 are formed such that flanges 213 are inserted into and welded to the welding grooves 111, so that the flanges 213 and the welding grooves 111 are capable of being fixed to each other. If necessary, in order to maintain the airtightness of the noise attenuation spaces 120, the flanges 213 and the welding grooves may be fixed to each other through screw-coupling or press-fitting.

Figure 5:
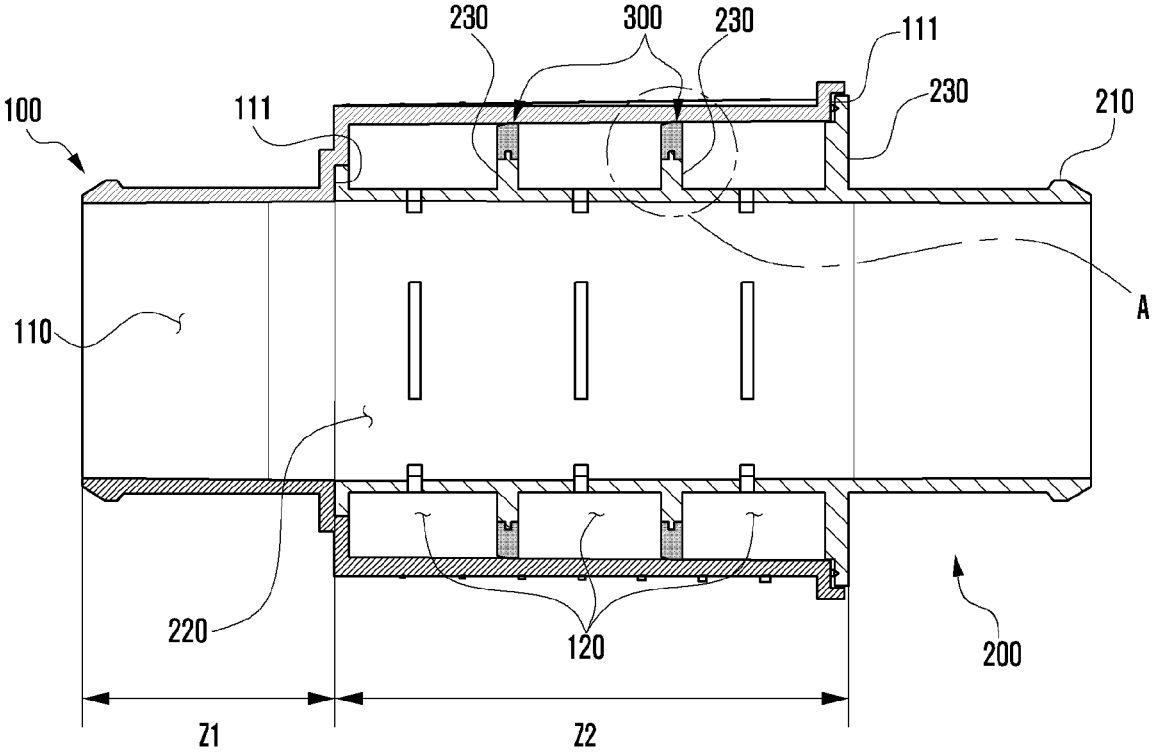
FIG. 5 is a longitudinal cross-sectional view of the resonator of FIG. 3.

In addition, as illustrated in FIGS. 4 and 5, the insert body 200 is a configuration, which is inserted into the above-described cover body 100, and includes, for example, an insertion pipe 210 and partition walls 230 as a configuration for dividing a space, into which intake noise is capable of flowing to be attenuated.

The insertion pipe 210 is formed generally in a cylindrical tube shape, opposite ends of which are opened, and has a second hollow portion 220 formed therein to extend in the longitudinal direction to communicate with the opposite opened ends.

One side of the insertion pipe 210 is inserted into the cover body 100 through the first hollow portion 110, and the other side of the insertion pipe 210 is exposed to the outside of the cover body 100 to be connected to a hose.

Threads are formed on the outer surface of the other side of the insertion pipe 210 connected to the hose such that the hose is capable of being screw-coupled thereto, and one or more flanges 213 to be inserted into the welding grooves 111 may be formed to protrude on the one side or the other side of the outer surface of the insertion pipe 210. In the disclosure, a case in which one pair of neighboring flanges 213 are formed on the outer surface of the insertion pipe 210 to face each other will be described as an example.

The flanges 213 fixedly installed to the cover body 100 are provided to be capable of maintaining the airtightness of the first hollow portion 110, and the pair of flanges 213 may be formed to protrude from the outer surface of the insertion pipe 210 to have different diameters such that the airtightness can be easily maintained depending on the diameter of the first hollow portion 110.

It is preferable that a stepped portion 215 to be inserted into the inside of the first hollow portion 110 be further formed to protrude on the outer surface of each flange 213 in order to maximize the ability to maintain the first hollow portion 110.

Meanwhile, on the outer surface of the insertion pipe 210, that is, the surface located within the first hollow portion 110, discharge holes 211 are formed in a radial arrangement through the insertion pipe 210 to communication with the second hollow portion 220 to be adjacent to each other in the longitudinal direction of the insertion pipe 210, so that intake noise introduced into the second hollow portion 220 can be discharged through the discharge holes 211.

At this time, it is preferable that the discharge holes 211 be formed at positions corresponding to the noise attenuation spaces 120 divided by the partition walls 230 (described later) such that the intake noise discharged through the discharge holes 211 is introduced into the noise attenuation spaces 120 so as to be absorbed.

The partition walls 230 are formed to protrude on the outer surface of the insertion pipe 210 to have a band shape and to be adjacent to each other in the longitudinal direction, and space partition members 300 are detachably fitted to the ends of the partition walls 230, respectively, so that the plurality of noise attenuation spaces 120 can be formed in the first hollow portion 110.

In the outer peripheral surface of each partition wall 230 to which a space partition member 300 is fitted, a protrusion 231 is formed to protrude in the longitudinal direction to be fitted into a fitting groove 310 formed in the inner surface of the space partition member 300, and the fitting groove 310 and the protrusion 231 may be formed to face each other.

The space partition members 300 are fitted to the ends of the above-described partition walls 210, respectively, so as to partition a plurality of noise attenuation spaces 120, airtightness of which is maintained, in the first hollow portion 110.

For example, the space partition member 300 may be made of a rubber material such as a soft rubber or silicone capable of restoring elasticity to have a shock-absorbing function, and may be formed through dual injection molding to generally have a ring shape to be fitted to the outer surfaces of the ends of the partition walls 230 each having a band shape.

In the inner peripheral surface of each space partition member 300, a fitting groove 310 is detachably fitted with the protrusion 231, and the outer peripheral surface of the space partition member 300 is in contact with the inner surface of the cover body 100, so that a plurality of noise attenuation spaces 120 can be divided inside the first hollow portion 110.

At this time, the outer peripheral surface of the space partition member 300 is formed to have a larger diameter than that of the first hollow portion 110 so that airtightness of the divided noise attenuation spaces 120 can be easily maintained, and it is preferable that the contact portion 320 formed by an inclined surface in the direction in which the cover body 100 is inserted be formed so that the airtightness can be more easily maintained.

Figure 6:
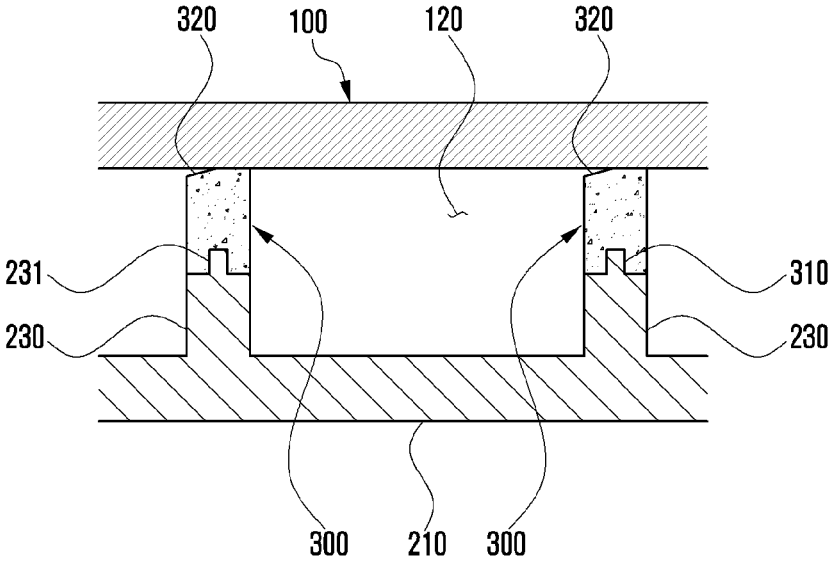
FIG. 6 is an enlarged view of a portion A in FIG. 5.
Figure 7:
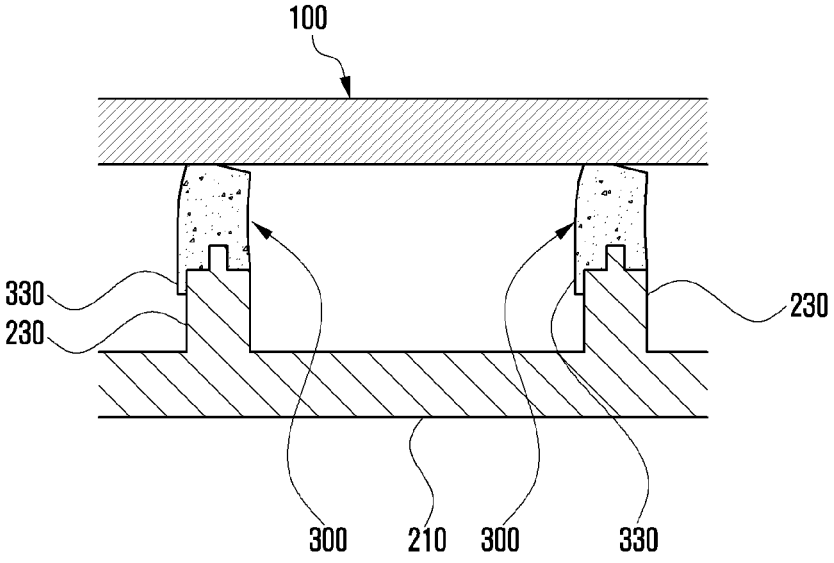
FIG. 7 is a view illustrating another embodiment of the space partition members illustrated in FIG. 6.

That is, as illustrated in the drawing, when the insertion pipe 210 is inserted into the first hollow portion 110, the outer peripheral surfaces of the space partition members 300 coupled to the partition walls 230 formed on the outer surface of the insertion pipe 210 are directed upwards, and the contact portions 320 directed upwards are capable of maximizing the contact area relative to the inner surface of the cover body 100 through the inclined surfaces thereof. Thus, unlike the prior art, each of the noise attenuation space 120 can be divided to maintain airtightness without pressurizing other configurations (see FIG. 6).

Each space partition member 300 may have an extension 330 formed to be directed downwards toward the partition wall 230 such that no clearance occurs in the connection portion between the space partition member 300 and the partition wall 230 as the outer surface of the space partition member 300 is pushed rearwards by the contact with the cover body 100, and, as illustrated in the drawings, the extension 330 is preferably formed only on the side surface on which the contact portion 320 is formed so as to extend downwards.

Unlike the prior art, the resonator 1 according to the disclosure configured as described above is capable of easily maintaining the airtightness of each of the noise attenuation spaces 120 divided by the space partition members 300 without pressing the space partition members 300.

In the foregoing, specific embodiments of the disclosure have been described in detail. However, it will be obvious to a person ordinarily skilled in the art to which the disclosure belongs that the technical idea and scope of the disclosure are not limited to the specific embodiments described above, and can be variously modified and changed without changing the gist of the disclosure.

Since the embodiments described above are provided in order to inform a person ordinarily skilled in the art to which the disclosure belongs of the scope of the disclosure, it is to be understood that that the above-described embodiments are illustrative and non-restrictive in every respect, and the disclosure is only defined by the scope of the claims.

What is claimed is:

1. A resonator having an excellent airtightness, the resonator comprising:

a cover body formed in a tube shape and having therein a first hollow portion formed to have different diameters in a longitudinal direction;

an insert body formed in a tube shape and inserted into the cover body and having therein a second hollow portion in a second longitudinal direction such that air of a turbocharger is introduced into the second hollow portion, the air introduced into the second hollow portion being guided into the first hollow portion on an outer surface of the insert body; and one or more space partition members coupled to the outer surface of the insert body to form a plurality of noise attenuation spaces in the first hollow portion, airtightness of each of the plurality of noise attenuation spaces being maintained;

wherein each of the one or more space partition members is formed in a ring shape having a predetermined diameter and has an outer diameter larger than an inner diameter of the cover body, each of the one or more space partition members is formed of a resilient material through double injection molding to have a shock-absorbing function by elastic restoration, and each of the one or more space partition members comprises a contact portion formed by an inclined surface to be in contact with an inner surface of the cover body in a direction in which the insert body is inserted into the cover body;

wherein the insert body comprises:

an insertion pipe having a cylindrical shape and comprising opposite ends opened to communicate with the second hollow portion, the insertion pipe being fixedly installed by being partially inserted into the cover body;

air discharge holes formed in an outer surface of the insertion pipe in a radial arrangement to be adjacent to each other in a longitudinal direction of the insertion pipe so as to discharge the air introduced into the second hollow portion to each of the plurality of noise attenuation spaces; and partition walls formed to protrude on the outer surface of the insertion pipe to have a band shape and to be adjacent to each other in the longitudinal direction of the insertion pipe, the one or more space partition members being detachably fitted to the partition walls so as to partition the plurality of noise attenuation spaces, wherein a protrusion is further formed to protrude at an outer peripheral surface of an end of each of the partition walls, wherein each protrusion is to be engaged with a corresponding one of the one or more space partition members in a male-female manner.

2. The resonator of claim 1, wherein each of the one or more space partition members further comprises an extension formed to extend downwards such that no clearance is formed in a connection portion between each of the one or more space partition members and corresponding ones of the partition walls.

* * * * *